US007439844B2

(12) United States Patent
Hase et al.

(10) Patent No.: US 7,439,844 B2
(45) Date of Patent: Oct. 21, 2008

(54) CORD TYPE THERMAL FUSE AND SHEET TYPE THERMAL FUSE

(75) Inventors: Yasuhiro Hase, Hamamatsu (JP); Hiroshi Nozue, Hamamatsu (JP)

(73) Assignee: Kurabe Industrial Co., Ltd., Hamamatsu-shi (JP)

( * ) Notice: Subject to any disclaimer, the term of this patent is extended or adjusted under 35 U.S.C. 154(b) by 294 days.

(21) Appl. No.: 10/526,980

(22) PCT Filed: Jun. 13, 2003

(86) PCT No.: PCT/JP03/07516

§ 371 (c)(1), (2), (4) Date: Mar. 7, 2005

(87) PCT Pub. No.: WO2004/025679

PCT Pub. Date: Mar. 25, 2004

(65) Prior Publication Data

US 2005/0258928 A1 Nov. 24, 2005

(30) Foreign Application Priority Data

Sep. 10, 2002 (JP) ..... 2002-263959
Dec. 24, 2002 (JP) ..... 2002-371175

(51) Int. Cl.
*H01H 85/04* (2006.01)
*H01H 85/20* (2006.01)
*H01H 85/10* (2006.01)

(52) U.S. Cl. ..... 337/159; 337/186; 337/290; 337/295

(58) Field of Classification Search ..... 337/159, 337/20, 123, 160, 14, 142, 158, 17–18, 203, 337/186, 227–228, 249, 279, 281, 290, 295; 174/120 R, 110 R, 68.1
See application file for complete search history.

(56) References Cited

U.S. PATENT DOCUMENTS 1,779,610 A * 10/1930 Lyndon ..... 337/415
2,217,284 A * 10/1940 Lunt ..... 174/25 R
2,253,984 A * 8/1941 Shanklin ..... 156/48
2,380,312 A * 7/1945 Johnson ..... 102/275.8
2,581,212 A * 1/1952 Spooner, Jr. et al. ..... 219/212
2,929,900 A * 3/1960 White ..... 337/246
3,253,104 A * 5/1966 Fister ..... 337/232
3,260,201 A * 7/1966 Kelly et al. ..... 102/275.1
3,683,309 A * 8/1972 Hirose ..... 338/214
3,828,119 A * 8/1974 Warburton et al. ..... 174/121 A (Continued)

FOREIGN PATENT DOCUMENTS

JP 05128950 A * 5/1993

(Continued)

*Primary Examiner*—Jayprakash N Gandhi
*Assistant Examiner*—Bradley H Thomas
(74) *Attorney, Agent, or Firm*—McGinn IP Law Group, PLLC

(57) ABSTRACT

A cord type thermal fuse, comprising a fuse core produced by winding a conductor meltable at a predetermined temperature on an insulating core member continuous in the length direction, and an insulating cover covering the outer periphery of the fuse core, wherein the conductor can be cut by expanding the insulating core member at a predetermined temperature and/or by contracting the insulating cover at the predetermined temperature.

19 Claims, 11 Drawing Sheets

U.S. PATENT DOCUMENTS

| | | | | | |
|---|---|---|---|---|---|
| 3,869,689 | A * | 3/1975 | Kasamatu | 337/164 |
| 3,925,745 | A * | 12/1975 | Blewitt | 337/279 |
| 4,177,444 | A * | 12/1979 | Taki | 337/163 |
| 4,230,041 | A * | 10/1980 | Bailey et al. | 102/275.8 |
| 4,253,080 | A * | 2/1981 | Howard | 337/159 |
| 4,319,212 | A * | 3/1982 | Leach | 337/159 |
| 4,680,567 | A * | 7/1987 | Edwards | 337/164 |
| 4,736,180 | A * | 4/1988 | Oh | 337/163 |
| 4,736,181 | A * | 4/1988 | Dornauer | 337/203 |
| 5,304,740 | A * | 4/1994 | Bozell et al. | 174/110 PM |
| 5,736,919 | A * | 4/1998 | Reeder | 337/227 |
| 6,191,678 | B1 * | 2/2001 | Edwards | 337/163 |
| 6,269,745 | B1 * | 8/2001 | Cieplik et al. | 102/202.5 |
| 6,538,550 | B1 * | 3/2003 | Muench et al. | 337/161 |
| 6,650,223 | B1 * | 11/2003 | Jollenbeck et al. | 337/297 |
| 2001/0019300 | A1 * | 9/2001 | Kaltenborn et al. | 337/155 |
| 2002/0101323 | A1 * | 8/2002 | Ranjan et al. | 337/158 |

FOREIGN PATENT DOCUMENTS

| | | | |
|---|---|---|---|
| JP | 06181028 | A * | 6/1994 |
| JP | 07176251 | A * | 7/1995 |
| JP | 9-129102 | | 5/1997 |
| JP | 09129102 | A * | 5/1997 |
| JP | 10223105 | A * | 8/1998 |
| JP | 11-86704 | | 3/1999 |

* cited by examiner

FIG. 5

| | | EXAMPLE 1 | EXAMPLE 2 | EXAMPLE 3 | EXAMPLE 4 | EXAMPLE 5 | EXAMPLE 6 | COMPARATIVE EXAMPLE 1 | COMPARATIVE EXAMPLE 2 |
|---|---|---|---|---|---|---|---|---|---|
| ELASTIC CORE | TENSILE RESISTANT MEMBER | GLASS CODE + SILICONE VARNISHING | GLASS CODE + SILICONE VARNISHING | GLASS CODE + SILICONE VARNISHING | GLASS CODE + SILICONE VARNISHING | GLASS CODE + SILICONE VARNISHING | GLASS CODE + SILICONE VARNISHING | GLASS CODE + SILICONE VARNISHING | GLASS CODE + SILICONE VARNISHING |
| | ELASTIC MEMBER | 100 W/T PARTS OF SILICONE RUBBER + 1 W/T PART OF FOAMING AGENT (AIBN) | 100 W/T PARTS OF SILICONE RUBBER + 2 W/T PART OF FOAMING AGENT (AIBN) | 100 W/T PARTS OF SILICONE RUBBER + 1 W/T PART OF FOAMING AGENT (AIBN) | 100 W/T PARTS OF SILICONE RUBBER + 3 W/T PARTS OF POLYACETAL HOMOPOLYMER | 100 W/T PARTS OF SILICONE RUBBER + 1 W/T PART OF FOAMING AGENT (AIBN) | 100 W/T PARTS OF SILICONE RUBBER + 1 W/T PART OF FOAMING AGENT (AIBN) | SILICONE RUBBER NO FOAMING AGENT | SILICONE RUBBER NO FOAMING AGENT |
| | OUTER DIAMETER | INSCRIBED CIRCLE: 1.6 mm CIRCUMSCRIBED CIRCLE: 1.8 mm (6 RADIAL PROTRUSIONS) | INSCRIBED CIRCLE: 1.6 mm CIRCUMSCRIBED CIRCLE: 1.8 mm (6 RADIAL PROTRUSIONS) | INSCRIBED CIRCLE: 1.6 mm CIRCUMSCRIBED CIRCLE: 1.8 mm (6 RADIAL PROTRUSIONS) | INSCRIBED CIRCLE: 1.6 mm CIRCUMSCRIBED CIRCLE: 1.8 mm (6 RADIAL PROTRUSIONS) | INSCRIBED CIRCLE: 1.6 mm CIRCUMSCRIBED CIRCLE: 1.8 mm (6 RADIAL PROTRUSIONS) | INSCRIBED CIRCLE: 1.6 mm CIRCUMSCRIBED CIRCLE: 1.8 mm (6 RADIAL PROTRUSIONS) | INSCRIBED CIRCLE: 1.6 mm CIRCUMSCRIBED CIRCLE: 1.8 mm (6 RADIAL PROTRUSIONS) | INSCRIBED CIRCLE: 1.6 mm CIRCUMSCRIBED CIRCLE: 1.8 mm (6 RADIAL PROTRUSIONS) |
| CONDUCTOR | | CENTER: FLUX INCLUDED EUTECTIC SOLDER WIRE 0.6 mmϕ | CENTER: FLUX INCLUDED EUTECTIC SOLDER WIRE 0.6 mmϕ | CENTER: FLUX NOT INCLUDED EUTECTIC SOLDER WIRE 0.6 mmϕ | CENTER: FLUX INCLUDED EUTECTIC SOLDER WIRE 0.6 mmϕ | CENTER: FLUX INCLUDED EUTECTIC SOLDER WIRE 0.6 mmϕ | CENTER: FLUX INCLUDED EUTECTIC SOLDER WIRE 0.6 mmϕ | CENTER: FLUX NOT INCLUDED EUTECTIC SOLDER WIRE 0.6 mmϕ | CENTER: FLUX INCLUDED EUTECTIC SOLDER WIRE 0.6 mmϕ |
| INSULATING COVER | | ETHYLENE COPOLYMER | ETHYLENE COPOLYMER | ETHYLENE COPOLYMER | ETHYLENE COPOLYMER | ETHYLENE PROPYLENE RUBBE | ETHYLENE COPOLYMER | ETHYLENE COPOLYMER | ETHYLENE COPOLYMER |
| SPACE LAYER (GLASS BRAID) | | YES | YES | YES | YES | YES | NO | YES | YES |
| EXPERIMENT 1 | | 183℃ | 183℃ | 183℃ | 183℃ | 183℃ | 183℃ | 183℃ | 183℃ |
| EXPERIMENT 2 | | 310℃ | 305℃ | 320℃ | 300℃ | 310℃ | 330℃ | 360℃ | 345℃ |

FIG. 7

| | | EXAMPLE 7 | EXAMPLE 8 | EXAMPLE 9 | EXAMPLE 10 |
|---|---|---|---|---|---|
| INSULATING CORE MEMBER | TENSILE RESISTANT MEMBER | GLASS CODE + SILICONE VARNISHING | GLASS CODE + SILICONE VARNISHING | GLASS CODE + SILICONE VARNISHING | GLASS CODE + SILICONE VARNISHING |
| | ELASTIC MEMBER | 100 W/T PARTS OF SILICONE RUBBER + 1 W/T PART OF FOAMING AGENT (AIBN) | 100 W/T PARTS OF SILICONE RUBBER + 1 W/T PART OF FOAMING AGENT (AIBN) | 100 W/T PARTS OF SILICONE RUBBER + 1 W/T PART OF FOAMING AGENT (AIBN) | 100 W/T PARTS OF SILICONE RUBBER + 1 W/T PART OF FOAMING AGENT (AIBN) |
| | OUTER DIAMETER | 1.8 mmϕ | 2.2 mmϕ | 2.2 mmϕ | 1.8 mmϕ |
| CONDUCTOR | | CENTER: FLUX INCLUDED NON-LEAD SOLDER WIRE 0.5 mmϕ | CENTER: FLUX INCLUDED NON-LEAD SOLDER WIRE 0.5 mmϕ | CENTER: FLUX INCLUDED NON-LEAD SOLDER WIRE 0.5 mmϕ | CENTER: FLUX INCLUDED NON-LEAD SOLDER WIRE 0.5 mmϕ |
| INSULATING COVER | | ETHYLENE COPOLYMER 6 INNER PROTRUSIONS 0.6 × 0.3 mm | ETHYLENE COPOLYMER 6 INNER PROTRUSIONS 0.6 × 0.3 mm | ETHYLENE COPOLYMER 6 INNER PROTRUSIONS 0.6 × 0.5 mm | ETHYLENE COPOLYMER NO INNER PROTRUSION |
| EXPERIMENT 1 | | 217℃ | 217℃ | 217℃ | 217℃ |
| EXPERIMENT 2 | | 340℃ | 310℃ | 350℃ | 370℃ |

FIG. 13

| | | EXAMPLE 11 | EXAMPLE 12 | EXAMPLE 13 | EXAMPLE 14 |
|---|---|---|---|---|---|
| INSULATING CORE MEMBER | TENSILE RESISTANT MEMBER | GLASS CODE + SILICONE VARNISHING | GLASS CODE + SILICONE VARNISHING | NO | GLASS CODE + SILICONE VARNISHING |
| | ELASTIC MEMBER | 100 W/T PARTS OF SILICONE RUBBER + 1 W/T PART OF FOAMING AGENT (AIBN) | 100 W/T PARTS OF SILICONE RUBBER + 1 W/T PART OF FOAMING AGENT (AIBN) | 100 W/T PARTS OF SILICONE RUBBER + 1 W/T PART OF FOAMING AGENT (AIBN) | 100 W/T PARTS OF SILICONE RUBBER + 1 W/T PART OF FOAMING AGENT (AIBN) |
| | OUTER DIAMETER | 1.8 mm $\phi$ | 1.8 mm $\phi$ | 1.2 mm $\phi$ | 1.8 mm $\phi$ |
| CONDUCTOR | | CENTER: FLUX INCLUDED NON-LEAD SOLDER WIRE 0.5 mm $\phi$ | CENTER: FLUX INCLUDED NON-LEAD SOLDER WIRE 0.5 mm $\phi$ | CENTER: FLUX INCLUDED NON-LEAD SOLDER WIRE 0.5 mm $\phi$ | CENTER: FLUX INCLUDED NON-LEAD SOLDER WIRE 0.5 mm $\phi$ |
| INSULATING COVER | | ETHYLENE COPOLYMER | ETHYLENE COPOLYMER | ETHYLENE COPOLYMER | ETHYLENE COPOLYMER |
| LINE-SHAPED INSULATOR | | POLYPHENYLENE SULFIDE MONOFILAMENT | POLYPHENYLENE SULFIDE MONOFILAMENT | POLYPHENYLENE SULFIDE MONOFILAMENT | *** |
| EXPERIMENT 1 | | 217℃ | 217℃ | 217℃ | 217℃ |
| EXPERIMENT 2 | | 330℃ | 310℃ | 350℃ | 370℃ |

FIG. 16

| | | EXAMPLE 15 | EXAMPLE 16 | EXAMPLE 17 | EXAMPLE 18 |
|---|---|---|---|---|---|
| INSULATING CORE MEMBER | TENSILE RESISTANT MEMBER | GLASS CODE + SILICONE VARNISHING | GLASS CODE + SILICONE VARNISHING | GLASS CODE + SILICONE VARNISHING | GLASS CODE + SILICONE VARNISHING |
| | ELASTIC MEMBER | 100 W/T PARTS OF SILICONE RUBBER + 1 W/T PART OF FOAMING AGENT (AIBN) | SILICONE RUBBER NO FOAMING AGENT | 100 W/T PARTS OF SILICONE RUBBER + 1 W/T PART OF FOAMING AGENT (AIBN) | 100 W/T PARTS OF SILICONE RUBBER + 1 W/T PART OF FOAMING AGENT (AIBN) |
| | OUTER DIAMETER | 1.8 mm $\phi$ | 1.8 mm $\phi$ | 1.8 mm $\phi$ | 1.8 mm $\phi$ |
| CONDUCTOR | | CENTER: FLUX INCLUDED NON-LEAD SOLDER WIRE 0.5 mm $\phi$ | CENTER: FLUX INCLUDED NON-LEAD SOLDER WIRE 0.5 mm $\phi$ | CENTER: FLUX INCLUDED EUTECTIC SOLDER WIRE 0.6 mm $\phi$ | CENTER: FLUX INCLUDED NON-LEAD SOLDER WIRE 0.5 mm $\phi$ |
| INSULATING COVER | | ETHYLENE COPOLYMER + EP RUBBER (CONTRACTED) 6 INNER PROTRUSIONS 0.6 × 0.3 mm | ETHYLENE COPOLYMER + EP RUBBER (CONTRACTED) 6 INNER PROTRUSIONS 0.6 × 0.3 mm | ETHYLENE COPOLYMER + EP RUBBER (CONTRACTED) 6 INNER PROTRUSIONS 0.6 × 0.3 mm | ETHYLENE COPOLYMER + EP RUBBER (CONTRACTED) 6 INNER PROTRUSIONS 0.6 × 0.3 mm |
| SPACE LAYER(GLASS BRAID) | | NO | NO | NO | YES |
| EXPERIMENT 1 | | 217℃ | 217℃ | 183℃ | 217℃ |
| EXPERIMENT 2 | | 320℃ | 370℃ | 320℃ | 320℃ |
| EXP.3 | 260℃ | 72 hr | 72 hr | 72 hr | 72 hr |
| | 280℃ | 4 hr | 4 hr | 4 hr | 4 hr |
| | 300℃ | 2 hr | 2 hr | 2 hr | 2 hr |

CORD TYPE THERMAL FUSE AND SHEET TYPE THERMAL FUSE

TECHNICAL FIELD

The present invention relates to a cord type thermal fuse and a sheet type thermal fuse, which can be disconnected when any part thereof is exposed in an abnormal high temperature state, so that the abnormal temperature can be detected. More particularly, the present invention relates to the cord type thermal fuse and the sheet type thermal fuse, of which disconnection time is still good even after being deteriorated due to aging by heat, and which has good operative reliability.

BACKGROUND ART

For example, according to Japanese Unexamined Patent Publication No. Hei 6-181028, there has been disclosed a cord type thermal fuse, comprising a space layer and an insulating cover layer around a center core member, on which a conductor meltable at a predetermined temperature is wound in the lateral direction on an elastic core. There are lead wires connected to the both ends of the conductor via terminals, and when the conductor melts at excessive temperature the electric connection between the lead wires is cut, whereby the abnormal state is detected.

According to Japanese Unexamined Patent Publication No. Hei 7-306750, there has also been disclosed a cord type thermal fuse, substantially having the same structure.

According to Japanese Unexamined Patent Publication No. 2000-231866, there has been disclosed a cord type thermal fuse, wherein a core wire, comprising a metal wire meltable at a predetermined temperature, is wound in the lateral direction with predetermined intervals on a core member and is inserted into a protection tube. The protection tube comprises a glass braid sleeve covered by an extruded silicone rubber.

With regard to these cord type thermal fuses, to promote the flow of the melted conductor or the metal wire during opening of the fuse, so as to improve the detecting accuracy, flux was applied to the conductor or the metal wire.

However, according to these types of cord type thermal fuses, since there have been high-integration of structure of combustion apparatus, the thermal ambience during long-term use becomes severer. Thus, the deterioration of flux would be prompted due to aging by heat, or the reliability of conductor would be lowered by heat, and it should be foreseen that a quick response to temperature would not be obtained after deterioration due to thermal aging.

Although attempts have been made to improve reliability for example, according to the cord type thermal fuse of Japanese Unexamined Patent Publication No. 2000-231866, there has been disclosed, as means to solve the problem, only the silicone rubber material, of which mechanical strength is normally low, and which requires reinforcing means as an exterior element. Thus, when the protection tube is ripped and damaged by edges, etc. of metal parts inside the combustion apparatus, there would be a higher risk of electric leakage by intrusion of water, and also a higher risk of prompted deterioration of flux due to aging by intrusion of exhaust gas.

In light of the above problems, it is an object of the present invention to provide a cord type thermal fuse, which can be disconnected when any part thereof is exposed in an abnormal high temperature state, so that the abnormal temperature can be detected accurately, in particular, of which disconnection time is still good even after being deteriorated due to aging by heat, and also to provide a sheet type thermal fuse, substantially having the same characteristic as that of the cord type thermal fuse as mentioned above.

DISCLOSURE OF INVENTION

To achieve the objects mentioned above, according to claim 1 of the present invention, there is provided a cord type thermal fuse comprising: a fuse core produced by winding a conductor meltable at a predetermined temperature on an insulating core member continuously provided in the length direction and an insulating cover covering the outer periphery of the fuse core, characterized in that: the conductor can be cut by expanding the insulating core member at a predetermined temperature and/or by contracting the insulating cover at the predetermined temperature.

According to claim 2 of the present invention, there is provided a cord type thermal fuse as claimed in claim 1, further characterized in that: the insulating core member has at least one or more protrusions formed continuously or intermittently in the length direction on the outer periphery of the insulating core member.

According to claim 3 of the present invention, there is provided the cord type thermal fuse as claimed in claim 1 or claim 2, further characterized in that: the insulating cover has at least one or more protrusions formed continuously or intermittently in the length direction on the inner periphery of the insulating cover.

According to claim 4 of the present invention, there is provided the cord type thermal fuse as claimed in claim 1, further characterized in that: another line-shaped or braid-shaped insulator is provided on the inner peripheral side of the insulating cover; and the conductor is sandwiched between the insulating core member and the line-shaped or braid-shaped insulator at least partially in the length direction of the conductor.

According to claim 5 of the present invention, there is provided the cord type thermal fuse as claimed in claim 4, further characterized in that: the line-shaped or braid-shaped insulator has a characteristic of contracting in the length direction around the melting temperature of the conductor.

According to claim 6 of the present invention, there is provided the cord type thermal fuse as claimed in claim 4, further characterized in that: the line-shaped or braid-shaped insulator has a characteristic of expanding in the peripheral direction around a melting temperature of the conductor.

According to claim 7 of the present invention, there is provided the cord type thermal fuse as claimed in any one claim of claim 1 through claim 6, further characterized in that: the insulating core member comprises a gas-containing material as a structural element.

According to claim 8 of the present invention, there is provided the cord type thermal fuse as claimed in claim 7, further characterized in that: the insulating core member comprises a gas-containing material covering a periphery of a tensile resistant member at the center of the insulating core member.

According to claim 9 of the present invention, there is provided a sheet type thermal fuse, comprising: the cord type thermal fuse according to any one claim of claim 1 through claim 8, provided on a flat surface in a serpentine manner; and means for fixing a layout of the cord type thermal fuse.

Accordingly, it is possible to obtain the cord type thermal fuse, which is surely disconnected at abnormal high temperature even at any position to which any compression force is not applied, and after disconnection, which has no risk of re-contact by melted conductor, etc., whereby any inappropriate operation is prevented. Further, it is also possible to obtain the sheet type thermal fuse substantially having the same characteristic as that of the cord type thermal fuse as mentioned above.

The thermal fuse of the present invention may further serve, not only for prevention of deterioration of operative reliability due to lost of flux function under practical using conditions, but also for improvement of operative reliability of aged cord type thermal fuse, against such as formation of surface oxide film due to thermal oxidization of conductor.

In addition, the thermal fuse of the present invention is useful, because there is substantially no change of the structure of such a thermal fuse as compared with that of conventional thermal fuses assembly, it is also possible to use widely as a safety device for various heat apparatus, by not increasing the production cost.

BRIEF DESCRIPTION OF DRAWINGS

FIG. 5 is a table according to the first and second embodiments of the present invention, showing results of various experiments in regard to examples 1 through 6, and comparative examples 1 and 2;

FIG. 7 is a table according to the fourth embodiment of the present invention, showing results of various experiments in regard to examples 7 through 10;

FIG. 13 is a table according to the fifth, sixth and seventh embodiments of the present invention, showing results of various experiments in regard to examples 11 through 14;

FIG. 16 is a table according to the ninth and tenth embodiments of the present invention, showing results of various experiments in regard to examples 15 through 18.

BEST MODE FOR CARRYING OUT THE INVENTION

A first embodiment of the present invention will be explained with reference to FIGS. 1, 2 and 5.

There is an elastic core 1 serving as an insulating core member, comprising a gas-containing material as a structural element. There is a tensile resistant member 1*a* at the center thereof, of which outer periphery is covered by a gas-containing elastic member 1*b*. A conductor 3 is wound on the outer periphery of the elastic core 1, and a space layer 5, comprising a glass braid, is provided on the outer peripheral side of the conductor 3. Further, an insulating cover 7 covers the outer periphery of the space layer 5.

Figure 1:
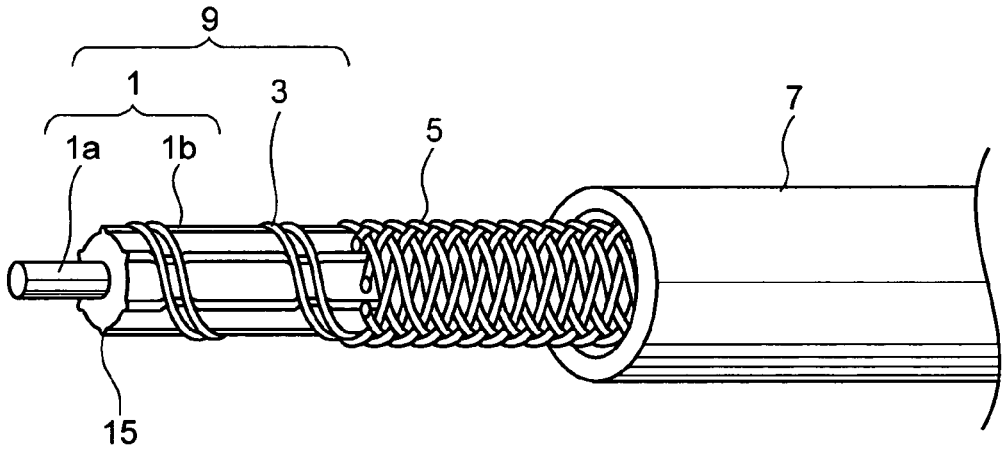
FIG. 1 is a perspective view according to a first embodiment of the present invention, in which a part of a cord type thermal fuse has been cut off.
Figure 2:
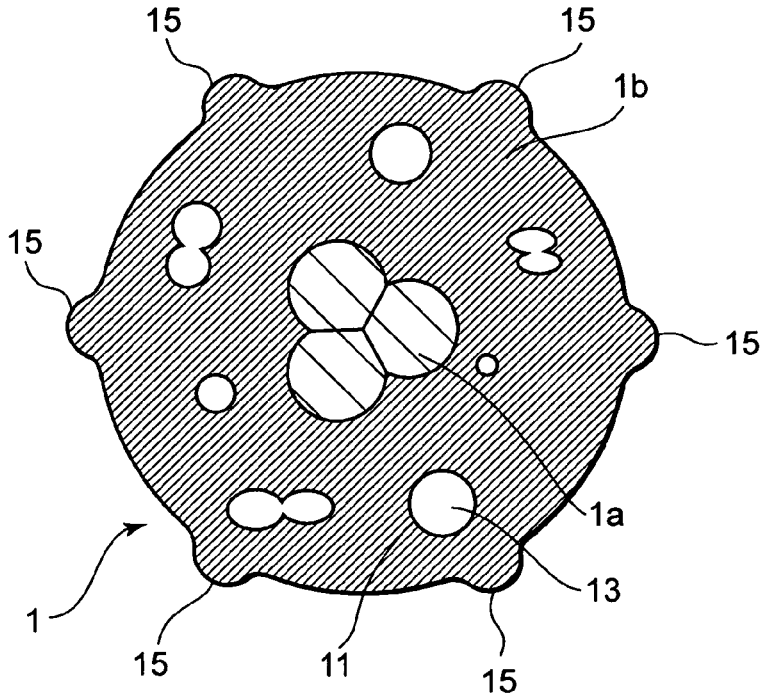
FIG. 2 is a sectional view of an elastic core serving as an element of a cord type thermal fuse according to the first embodiment of the present invention.

For reference, as illustrated in FIG. 2, although the tensile resistant member 1*a* is actually composed of a plurality of fiber bundles, FIG. 1 shows them in a single circular shape as a typical model.

The elastic core 1 and the conductor 3 serve as a fuse core 9. As illustrated in FIG. 2, there are several airtight spaces 11 inside the elastic member 1*b* of the elastic core 1, and gas 13 is included in each airtight space 11.

The tensile resistant member 1*a* has a function to improve the tensile strength and flexibility of a cord type thermal fuse, and it is possible to use any known textile material as a practical material thereof.

The elastic member 1*b* is composed of ordinary elastomer material, etc., having the airtight spaces 11, of which respective shapes are delomorphous or amorphous, preferably at least any part in the inside of the elastic member 1*b*. It is possible to use, for example, foamed elastic material having isolated air holes, partially foamed elastic material, or elastic material having continuous holes in the length direction so that the airtight spaces 11 may be formed in the post-process.

The elastic member 1*b* as discussed above may be formed by any known method. There are various methods, for example, such as that the elastomer material serving as the elastic member 1*b* has been mixed with organic foaming agent or inorganic foaming agent, and the mixture is heated and, thus foamed, whereby the foamed elastic member having isolated air holes can be formed. Further, it is also possible to use other methods, such as forming of foamed elastic member by including gas during extrusion molding of elastomer material, or forming of partially foamed elastic member by adding sublimation material powder through heat-aging to elastomer material, or forming of the airtight spaces 11, by preliminarily preparing elastic member having continuous holes in the length direction during contour extrusion of elastomer material, and in the post-process, by closing the continuous holes in the length direction at predetermined intervals through use of winding tension of the conductor 3.

The cross-sectional shape of the elastic core 1 is not limited in particular, but it is preferable, as illustrated in FIG. 2, to provide a cross-sectional shape having a plurality (in the present embodiment, six) of protrusions 15 in the radial directions. This shape may be any polygon, or any starlike shape. Further, although polygonal shapes or starlike shapes have definite corners in general, the corners may also be in depressed and round shapes. According to these cross-sectional shapes, compared with the circular cross-sectional shape, the conductor 3 can dig into the elastic core 1 easily, and it is preferable, because the conductor 3 may be cut immediately when the elastic core 1 is melted. When the cross-sectional shape is a polygon, it is preferable to select a hexagon or less, because of easy digging of the conductor 3.

As for the conductor 3, it is possible to use, for example, metal thin wire selected from the group of low-melting point alloys and solder, or wire formed from conductive resin manufactured by filling high-density metal powder, metal oxide or carbon black, into thermoplastic resin such as olefin resin or polyamide resin. The preferable wire diameter of the conductor 3 is substantially from 0.04 mm to 0.8 mm, because an ordinary winding machine can wind such a conductor 3 around the elastic core 1 in the length direction.

It is also possible to apply flux to the conductor 3. The flux may be included in the center of the conductor 3, or the flux may be coated on the surface of the conductor 3. It is possible to use ordinary rosin flux, or it is also possible to use flux having a small volume of activator.

The conductor 3 has been wound around the elastic core 1 by applying tension, so that the conductor 3 may not at least be loose, thus the fuse core 9 is prepared. Each interval of winding the conductor 3 is, preferably, not less than one and half of the wire diameter, and more preferably, not less than twice and not more than 15 times. It is also possible to provide collective winding in the length direction by winding the parallel conductors 3 or by winding the stranded conductors 3.

The thus obtained fuse core 9 is covered by the insulating cover 7 via the space layer 5, whereby the cord type thermal fuse according to the present embodiment is completed.

As there are various known methods in regard to the insulating cover 7, it is possible to select any appropriate method from them, which can realize the working temperature lower than the melting temperature of the conductor 3. It is possible to use the method, for example, in which a thermoplastic polymer such as ethylene copolymer workable at relatively low temperatures, or a composition chiefly comprising synthetic rubber such as ethylene propylene rubber, styrene butadiene rubber, butadiene rubber isoprene rubber or nitrile rubber, is cross-linked by using low-temperature cross-linking method such as radiation cross-linking or Silane cross-linking. Further, it is also possible to use a forming method by using silicone rubber which can be extruded around normal temperature and which can be cross-linked at relatively low temperature, or a forming method, in which, after covering by braid of any textile material, the insulating varnish, parched at normal temperature, is coated. In particular, when the silicone rubber is used, it is also possible to provide a braid as an exterior element in order to reinforce the mechanical strength of the insulating cover 7. The insulating cover 7 may be provided, not only by the extrusion method as discussed above, but also by first forming a tubular insulating cover 7 separately, and thereafter, by inserting the fuse core 9 provided with the space layer 5. The insulating cover 7 may be preferably thin, because of the increasing heat sensitivity, as long as the required characteristics such as the electric insulation ability and mechanical strength are satisfied.

Preferably, the insulating cover 7 is not in tight contact with the fuse core 9, but is covering the space layer 5 as discussed in the present embodiment. This is because, by providing the space layer 5, the re-connection of the conductor 3 after detecting abnormal temperature may be prevented more effectively, and at the same time, the conductor 3 may be protected against the heat while the insulating cover 7 is provided.

The space layer 5 may be formed by any known method, for example, in which the insulating cover 7 is provided around the fuse core 9 through tubing extrusion, or in which an insulating cover provided with protrusions on the inner periphery thereof is extruded in order to cover around the fuse core 9, or in which a spacer is provided. These methods are disclosed in detail, in Japanese Unexamined Patent Applications Nos. Hei 5-128950, Hei 6-181028, Hei 7-176251, Hei 9-129120 and Hei 10-223105, all of which were filed by the applicant of the present invention. Thus, any of these methods may be used.

Now several examples according to the first embodiment will be explained.

EXAMPLE 1

The elastic core 1 was manufactured by the following methods. First, silicone varnishing was applied to a glass cord having the outer diameter of about 0.7 mm, thus the tensile resistant member 1*a* was provided. Thereafter, a silicone rubber, comprising a compound of 100 w/t parts (part by weight) of silicone rubber, 1 w/t part of foaming agent (AIBN) and 2 w/t parts of organic peroxide cross-linking agent kneaded on open roll, was extruded in order to cover the periphery of the tensile resistant member 1*a*, so that the cross-section of the silicone rubber had six radial protrusions, of which inscribed circle was 1.6 mm and of which circumscribed circle was 1.8 mm. At the same time, the silicone rubber was foamed by applying hot-air vulcanization. Thus, the foamed elastic member 1*b*, having isolated air holes, was formed.

Thereafter, two parallel conductors 3, respectively comprising 0.6 mm of eutectic solder wire (melting temperature at 183° C.) in which flux had been included at the center, were drawn at the same tension and wound at an interval of 8.5 mm in the length direction around the corners of the elastic core 1. Then, non-alkali glass filaments, each of which fiber diameter was about 9 μm, were stranded together in order to obtain a fiber bundle (yarn number: around #70), and this fiber bundle was braided by 16-yarn string manufacturing machine (using 16 yarns for manufacturing a single string), at braid coverage of about 17/25 mm, thus the space layer (glass braid) 5 was obtained. As the final step, a mixture of ethylene copolymer, serving as the insulating cover 7, was extruded to form the cover at thickness of 0.5 mm and at extrusion temperature of 150° C., and thereafter, the cross-linking was done by applying electron beam thereto.

The thus obtained cord type thermal fuse was cut at length of about 20 cm, and the insulating cover 7 and the space layer (glass braid) 5 at each end were removed for about 1 cm respectively. Then, lead wires having the nominal cross-sectional area of 0.5 $mm^2$, each of which was at length of 100 mm, were connected via crimp-type terminals, thus the cord type thermal fuse assembly was manufactured.

Then, Experiments 1 and 2 were respectively done for the thus obtained cord type thermal fuse, as follows:

EXPERIMENT 1

Initial Operative Temperature

Experiment Method:

The cord type thermal fuse assembly manufactured by the above method was inserted in a glass fiber braid tube at inner diameter of 4.0 mm and at length of about 15 cm, so that the cord type thermal fuse part of the assembly may come to the center part of the tube. Thereafter, an electric current about 0.1 A was applied from 100 V AC power supply, by connecting incandescent bulb to the both terminals of the lead wires as an outer load. Then, the center part was heated from normal temperature, at temperature increase speed of 10° C./min. Thus, when the conductor 3 was disconnected, the temperature was checked.

EXPERIMENT 2

Operative Temperature After Lost of Flux

Experiment Method:

The manufactured cord type thermal fuse assembly was placed in a hot-air circulation type of constant-temperature bath at temperature of 158° C., for 384 hours, whereby the deterioration due to aging by heat was prompted, and the flux was decomposed and removed by heat. Thereafter, the cord type thermal fuse assembly after heat treatment was inserted in a glass fiber braid tube at inner diameter of 4.0 mm and at length of about 15 cm, so that the cord type thermal fuse part of the assembly may come to the center part of the tube. Thereafter, an electric current about 0.1 A was applied from 100 V AC power supply, by connecting incandescent bulb to the both terminals of the lead wires as an outer load. Then, the center part was heated from initial temperature of 250° C., at temperature increase speed of 10° C./min. Thus, when the conductor 3 was disconnected, the temperature was checked.

The results of Experiments 1 and 2 are shown in FIG. 5.

EXAMPLE 2

The tensile resistant member 1*a*, having isolated air holes, was formed by using silicone rubber to which 2 w/t parts of foaming agent (AIBN) were added. The other materials and manufacturing method were substantially the same as those of Example 1, thus the cord type thermal fuse was manufactured. Then the experiments, substantially the same as those of Example 1, were done for this cord type thermal fuse, of which results are also included in FIG. 5.

EXAMPLE 3

As for the conductor 3, 0.6 mm of eutectic solder wire without including flux was used. The other materials and manufacturing method were substantially the same as those of Example 1, thus the cord type thermal fuse was manufactured. Then the experiments, substantially the same as those of Example 1, were done for this cord type thermal fuse, of which results are also included in FIG. 5.

EXAMPLE 4

The tensile resistant member 1*a* was prepared by a glass cord having the outer diameter of about 0.7 mm, to which silicone varnishing was not applied. Thereafter, a silicone rubber, comprising a compound of 100 w/t parts of silicone rubber, 3 w/t parts of polyacetal homopolymer powder (particles passed through 100-mesh sieve) and 2 w/t parts of organic peroxide cross-linking agent kneaded on open roll, was extruded in order to cover the periphery of the tensile resistant member 1*a*, so that the cross-section of the silicone rubber had six radial protrusions, of which inscribed circle was 1.6 mm and of which circumscribed circle was 1.8 mm. At the same time, hot-air vulcanization was applied, thus the elastic member 1*b* was formed. The subsequent steps were substantially the same as those of Example 1, and the cord type thermal fuse was manufactured. The elastic core 1 at this stage was a silicone rubber elastic core including scattered polyacetal homopolymer powders, and there was no air hole in the inside thereof.

Then, Experiment 1 as discussed above was done for the cord type thermal fuse in this state.

Thereafter, the cord type thermal fuse assembly was manufactured substantially by the same method as that of Example 1. Then, the manufactured cord type thermal fuse assembly was placed in a hot-air circulation type of constant-temperature bath at temperature of 158° C., for 384 hours, whereby the deterioration due to aging by heat was prompted, thus the state after deterioration due to aging was reproduced. At this stage, the polyacetal homopolymer powder had been sublimed by heat, whereby the foamed elastic member 1*b* having isolated air holes was formed.

With reference to this Example, the cord type thermal fuse in this state was heated from temperature of 300° C., at temperature increase speed of 10° C./min, and the disconnected temperature was checked as results of Experiment 2. Then the results of Experiment 1 and Experiment 2 were also included in FIG. 5.

EXAMPLE 5

As the insulating cover, instead of using mixture of ethylene copolymer, mixture of ethylene propylene rubber was used, which was then extruded at temperature of 130° C. in order to form the cover. The other materials and manufacturing method were substantially the same as those of Example 1, thus the cord type thermal fuse was manufactured. Then the experiments, substantially the same as those of Example 1, were done for this cord type thermal fuse, of which results are also included in FIG. 5.

COMPARATIVE EXAMPLE 1

The elastic core was formed by using silicone rubber to which no foaming agent was added, and 0.6 mm of eutectic solder wire without including flux was used as the conductor. The other materials and manufacturing method were substantially the same as those of Example 1, thus the cord type thermal fuse was manufactured. Then the experiments, substantially the same as those of Example 1, were done for this cord type thermal fuse, of which results are also included in FIG. 5.

COMPARATIVE EXAMPLE 2

The elastic core was formed by using silicone rubber to which no foaming agent was added, and 0.6 of eutectic solder wire including flux at the center thereof was used as the conductor. The other materials and manufacturing method were substantially the same as those of Example 1, thus the cord type thermal fuse was manufactured. Then the experiments, substantially the same as those of Example 1, were done for this cord type thermal fuse, of which results are also included in FIG. 5.

According to results of FIG. 5, it is understood that the initial operative temperature of each Example is the melting temperature of the conductor 3 (183° C.).

With reference to the operative temperature after the loss of flux, it is understood that, as compared with the operative temperature of the conventional cord type thermal fuse (Comparative Example 2), that of the cord type thermal fuse according to the present embodiment, of which elastic core 1 is comprising, the tensile resistant member 1*a*, and the elastic member 1*b* covering around the tensile resistant member 1*a* and including the air, becomes lower. Further, with reference to Examples 2 and 4 having more isolated air holes, as compared with Examples 1 and 5, the operative temperature becomes still lower.

With reference to the cord type thermal fuse of Example 3, using the conductor 3 to which the flux application was not done, as compared with the cord type thermal fuses of Examples 1, 2, 4 and 5, the operative temperature becomes higher. It is considered that, the reason will be because of larger conductor area rate of the conductor 3 as compared with that of the non-flux conductor. Similarly, it is understood that, as compared with the cord type thermal fuse, the operative temperature becomes higher.

Figure 3:
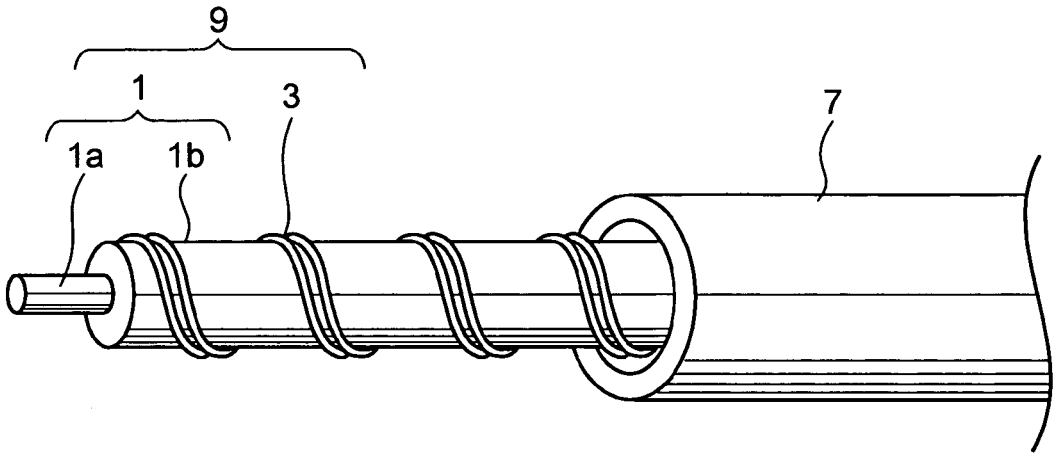
FIG. 3 is a perspective view according to a second embodiment of the present invention, in which a part of a cord type thermal fuse has been cut off.

Now a second embodiment of the present invention will be explained with reference to FIG. 3. According to the second embodiment, with reference to the first embodiment, the space layer (glass braid) 5 has been removed.

The other structure is substantially the same as that of the first embodiment as discussed above, and the identical numerals are allotted to the identical elements, and the explanation thereof will not be made.

With reference to the second embodiment, substantially the same experiments as those of Experiments 1 and 2 were done as Example 6, and the results are also included in FIG. 5.

According to results of FIG. 5, it is understood that the initial operative temperature is the melting temperature of the conductor 3 (183° C.).

With reference to the operative temperature after the lost of flux, it is understood that, as compared with the operative temperature of the conventional cord type thermal fuse (Comparative Example 2, as discussed above), that of the cord type thermal fuse according to the present embodiment, of which elastic core 1 is comprising, the tensile resistant member 1*a*, and the elastic member 1*b* covering around the tensile resistant member 1*a* and including the air, becomes lower.

Figure 4:
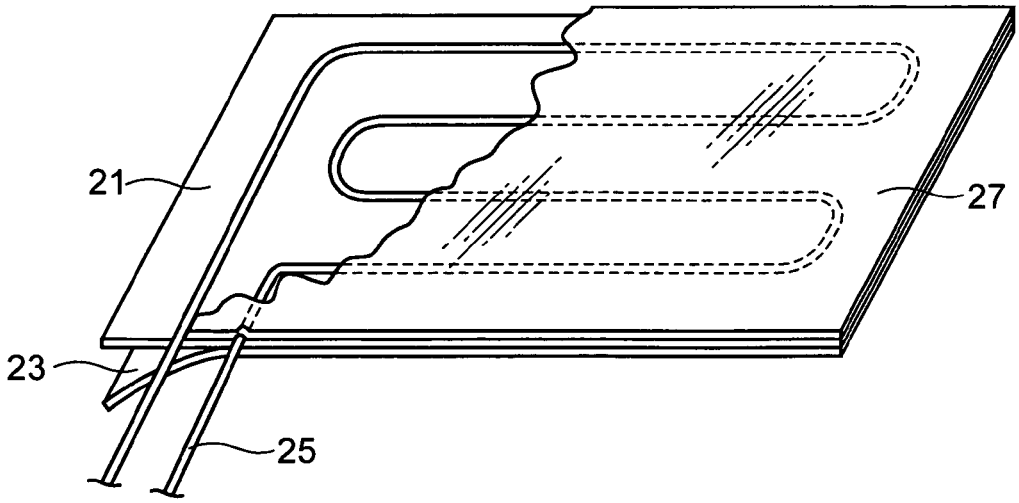
FIG. 4 is a perspective view according to a third embodiment of the present invention, in which a part of a cord type thermal fuse has been cut off.

Now a third embodiment of the present invention will be explained with reference to FIG. 4. As illustrated in FIG. 4, a sheet type thermal fuse was manufactured, by placing the cord type thermal fuse according to the first embodiment as discussed above, in a serpentine manner by any method such as that disclosed in Japanese Unexamined Patent Publication No. Sho 62-44394. Reference numeral 21 shows a double-faced adhesive paper, having a peeling paper 23 on one side. Reference numeral 25 shows the sheet type thermal fuse, positioned in a serpentine manner on the upper surface of the double-faced adhesive paper 21. Further, reference numeral 27 shows a metal foil covering the whole part of the sheet type thermal fuse 25, and the metal foil 27 has been adhered to and fixed on the double-faced adhesive paper 21.

An acrylic adhesive paper is used as the double-faced adhesive paper 21, and an aluminum foil at thickness of 100 μm is used as the metal foil 27.

Since the present embodiment was provided according to Japanese Unexamined Patent Publication No. Sho 62-44394, the metal foil 27 and the double-faced adhesive paper 21 are used. However, it is possible to manufacture by not referring to this Unexamined Patent Publication, or it is also possible to use other material, such as a plastic film instead of the metal foil.

The thus manufactured sheet type thermal fuse was attached to an iron panel at thickness of 0.5 mm, and the panel was placed in upright position. A commercially available wall paper was attached to the reverse side of the panel. In this state, 0.5 A of electric current was applied to the sheet type thermal fuse, and a burner was moved closer so that the burner flame was in contact with the panel. This state was maintained until the conductor of the thermal fuse was disconnected. Thereafter, the sheet type thermal fuse detected the heat, and was disconnected. After disconnection, there was no change, such as carbonization of the wall paper on the reverse side of the panel, and it was found that the thermal fuse expressed the effective performance.

Figure 6:
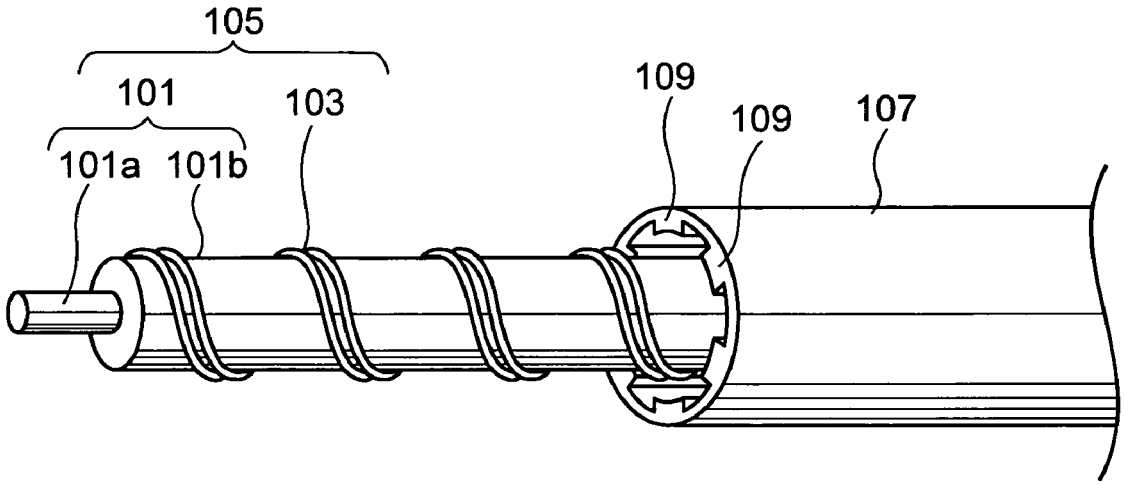
FIG. 6 is a perspective view according to a fourth embodiment of the present invention, in which a part of a cord type thermal fuse has been cut off.

Now a fourth embodiment of the present invention will be explained with reference to FIGS. 6 and 7. According to the present embodiment, an insulating core member 101 has a tensile resistant member 110*a* at the center, around which is covered by a polymer elastic member 101*b* including the air. A conductor 103 is wound around the insulating core member 101. Thus, the insulating core member 101 and the conductor 3 serve as a fuse core 105. Further, the fuse core 105 is covered by an insulating cover 107. The insulating cover 107 has at least one or more (in the present embodiment, six) protrusions 109, formed continuously or intermittently on the inner surface in the length direction.

The insulating core member 101 is formed by any material, having characteristic of being not melted around the melting temperature of the conductor 103, and also characteristic of expanding in the circumferential direction, for example, any metal wire to which insulation process has been applied, such as an electric wire in which thermoplastic polymer or thermoset polymer has been extruded on a conductor, or cable material comprising any polymer which has been formed by plastic extrusion of synthetic fiber, thermoplastic polymer or thermoset polymer, or any inorganic material such as ceramic fiber or glass fiber. Any one of the above materials may be used as a single material, but it is also possible to use a plurality of materials by applying the same tension thereto, or by stranding together, or by preparing composite material through combination of different material types.

As discussed above, among these materials according to the present embodiment, with reference to the structure in which the tensile resistant member 101*a* at the center is covered by the polymer elastic member 101*b* including the air, it is possible to reinforce the mechanical strength appropriately, and at the same time, it is also possible to arbitrarily control the degree of expansion of the polymer elastic member 101*b* including the air.

The tensile resistant member 101*a* may be used for the purpose of improving the tensile strength and flexibility of the cord type thermal fuse obtained by the present embodiment. The tensile resistant material 101*a* may be formed by using any known textile material.

The polymer elastic member 101*b* including the air as discussed has the structure that delomorphous or amorphous airtight spaces have been formed, preferably at least any part in the inside of the elastic material comprising ordinary elastomer material, for example, silicone rubber, ethylene propylene rubber, natural rubber, isoprene rubber, acrylic rubber, fluorocarbon rubber, ethylene-vinyl acetate copolymer (EVA), ethylene-ethyl acrylate copolymer resin (EEA), or any thermoplastic elastomer (TPE). It is possible to use, for example, foamed elastic material having isolated air holes, partially foamed elastic material, or elastic material having continuous holes in the length direction so that the airtight spaces may be formed in the post-process.

The elastic member 101*b* as discussed above may be formed by any known method. There are various methods, for example, such as that the elastomer material serving as the elastic member has been mixed with organic foaming agent or inorganic foaming agent, and the mixture is heated and thus foamed, whereby the foamed elastic member having isolated air holes can be formed. Further, it is also possible to use other methods, such as forming of foamed elastic member by including gas during extrusion molding of elastomer material, or forming of partially foamed elastic member by adding sublimation material powder through heat-aging to elastomer material, or forming of the airtight spaces, by preliminarily preparing elastic member having continuous holes in the length direction during contour extrusion of elastomer material, and in the post-process, by closing the continuous holes in the length direction through use of winding tension of the conductor, which will be explained afterwards.

As for the conductor 103, it is possible to use, for example, metal thin wire selected from the group of low-melting point alloys and solder, or wire formed from conductive resin manufactured by filling high-density metal powder, metal oxide or carbon black, into thermoplastic resin such as olefin resin or polyamide resin. The preferable wire diameter of the conductor 103 is substantially from 0.04 mm to 2.0 mm, because an ordinary winding machine can wind such a conductor 103 around the elastic core in the length direction.

The conductor 103 has been wound around the insulating core member 101 by applying tension, so that the conductor 103 may not at least be loose, thus the fuse core 105 is prepared. It is more preferable to select the polymer elastic member 101*b* including the air as the insulating core member 101, because the conductor 103 may dig into the insulating core member 101 sufficiently. The each interval of winding the conductor 103 is, preferably, not less than one and half of the wire diameter, and more preferably, not less than twice and not more than 15 times. It is also possible to provide collective winding in the length direction by winding the paralleled conductors 3 or by winding the stranded conductors 103.

The thus obtained fuse core 105 is covered by the insulating cover 107, whereby the cord type thermal fuse according to the present embodiment is completed. As discussed above, according to the present embodiment, the insulating cover 107 has at least one or more (in the present embodiment, six) protrusions 109, formed continuously or intermittently on the inner surface in the length direction. The protrusions 109 have been provided because of the following reason.

This is because, when the insulating core member 101 is heated by any abnormal state and expanded in the circumferential direction, the conductor 103 wound around the insulating core member 101 is pressed between the insulating core member 101 and the protrusions 109 provided on the inner periphery of the insulating cover 107, whereby the conductor 103 may be disconnected more surely by pressure during melting or just before melting thereof.

The protrusions 109 have further merits. As a predetermined space may be formed between the fuse core 105 and the insulating cover 107, after the conductor 103 is disconnected by detecting abnormal temperature, it is possible to prevent re-connection of the conductor 103 by re-heating more effectively.

As there are various known methods in regard to the insulating cover 107, it is possible to select any appropriate method from them, which can be worked at lower temperature than the melting temperature of the conductor 103. It is possible to use the method, for example, in which a thermoplastic polymer such as ethylene copolymer workable at relatively low temperature, or a synthetic rubber such as ethylene propylene rubber, styrene butadiene rubber, isoprene rubber or nitrile rubber, is cross-linked by using low-temperature cross-linking method such as radiation cross-linking. Further, it is also possible to use a forming method by using silicone rubber which can be extruded around normal temperature and which can be cross-linked at relatively low temperature. In particular, when the silicone rubber is used, it is also possible to provide a braid as exterior element in order to reinforce the mechanical strength of the insulating cover 107. The insulating cover 107 may be provided, not only by the extrusion method as discussed above, but also by first forming a tubular insulating cover 107 separately, and thereafter, by inserting the fuse core 105. The insulating cover 107 may be preferably thin, because of the increasing heat sensitivity, as long as the required characteristics such as the electric insulation ability and mechanical strength are satisfied. It is preferable that the size of each protrusion 109 protruding in the circumferential direction is smaller because of the increasing heat sensitivity, as long as the required characteristic in order to prevent the re-connection is satisfied.

According to the present embodiment, when the temperature increases, the insulating core member 101 is expanded in the circumferential direction, and presses the conductor 103 toward the protrusions 109 on the inner periphery of the insulating cover 107, whereby the conductor 103 may be disconnected more surely during melting or just before melting thereof. Thus, even when the original function of flux (the function to improve the detecting accuracy) is deteriorated, it is still possible to maintain the good disconnection time. Further, it is still effective even when any deterioration, such as forming of oxide, appears on the surface of the conductor 103 due to long-term use thereof and the melting disconnection cannot be done easily. As the structure of parts is not changed from conventional structure, and no complicated structure is required. Thus, it is possible to provide cost-effective products.

Now several examples according to the present embodiment will be explained.

EXAMPLE 7

First, silicone varnishing was applied to a glass cord having the outer diameter of about 0.7 mm, thus the tensile resistant member 101*a* was provided. Thereafter, a silicone rubber, comprising a compound of 100 w/t parts of silicone rubber, 1 w/t part of foaming agent (AIBN) and 2 w/t parts of organic peroxide cross-linking agent kneaded on open roll, was extruded in order to cover the periphery of the tensile resistant member 101*a*, so that the cross-section of the outer diameter was 1.8 mm. At the same time, the silicone rubber was foamed by applying hot-air vulcanization. Thus, the insulating core member 101 was formed.

Thereafter, two parallel conductors 103, respectively comprising 0.5 mm.phi. of non-lead solder wire (tin-copper alloy, melting temperature at 217° C.) in which flux had been included at the center, were drawn at the same tension and wound at winding pitch of 5 times/10 mm (4 times the wire diameter) in the length direction around the insulating core member 101. As the final step, a mixture of ethylene copolymer serving as the insulating cover 107 was extruded at temperature of 150° C., so that the six protrusions 109, of which respective width was 0.6 mm and height was 0.3 mm, and of which thickness was 0.3 mm, were provided. Thereafter, the cross-linking was done by applying electron beam thereto.

The thus obtained cord type thermal fuse was cut at length of about 20 cm, and each end of the insulating cover 107 was removed for about 1 cm. Then, lead wires having the nominal cross-sectional area of 0.5 $mm^2$, each of which was at length of 100 mm, were connected via crimp-type terminals, thus the cord type thermal fuse assembly was manufactured.

Then, Experiments 1 and 2, substantially the same as those of the first embodiment, were respectively done for the thus obtained cord type thermal fuse, of which results are shown in FIG. 7.

EXAMPLE 8

The outer diameter of the insulating core member 101 was changed from 1.8 mm to 2.2 mm. The other manufacturing method was substantially the same as that of Example 7, thus the cord type thermal fuse was manufactured. Then the experiments, substantially the same as those of Examples 1 and 2, were done for this cord type thermal fuse, of which results are also included in FIG. 7.

EXAMPLE 9

The outer diameter of the insulating core member 101 was changed from 1.8 mm to 2.2 mm, and the height of each protrusion 109 was also changed from 0.3 mm to 0.5 mm. The other manufacturing method was substantially the same as that of Example 7, thus the cord type thermal fuse was manufactured. Then the experiments, substantially the same as those of Examples 1 and 2, were done for this cord type thermal fuse, of which results are also included in FIG. 7.

EXAMPLE 10

There was no protrusion on the inner surface of the insulating cover 107. The other manufacturing method was substantially the same as that of Example 7, thus the cord type thermal fuse was manufactured. Then the experiments, substantially the same as those of Examples 1 and 2, were done for this cord type thermal fuse, of which results are also included in FIG. 7.

According to results of FIG. 7, it is understood that the initial operative temperature of each Example is the melting temperature of the conductor (217° C.).

With reference to the operative temperature after the lost of flux, it is understood that the operative temperature of the cord type thermal fuse according to Examples 7 through 9 becomes lower, in which the insulating core member 101, comprising the material having characteristic of expanding in the circumferential direction, is combined with the insulating cover 107 having the protrusions 109 on the inner surface. In particular, according to Example 8 in which the outer diameter of the insulating core member 101 was enlarged, the operative temperature was the lowest. This is because the space between the insulating core member 101 and the protrusions 109 becomes narrower, and because the pressure against the conductor 103 becomes larger due to increase of expanding volume of the insulating core member 101. Further, with reference to Example 9 in which the height of the protrusions 109 was larger, the operative temperature was good, but as compared with Examples 7 and 8, the operative temperature was rather higher. This is because, as the protrusions 109 became larger, it became more difficult to transfer the heat from the outside to the conductor 103 correspondingly, thus the heat sensitivity became poor. On the other hand, with reference to the cord type thermal fuse according to Example 10 in which there was no protrusion 109 on the inner surface of the insulating cover 107, the operative temperature became relatively higher. This is because, as there was no protrusion 109, it was difficult to apply pressure, generated by expansion of the insulating core member 101, to the conductor 103.

Figure 8:
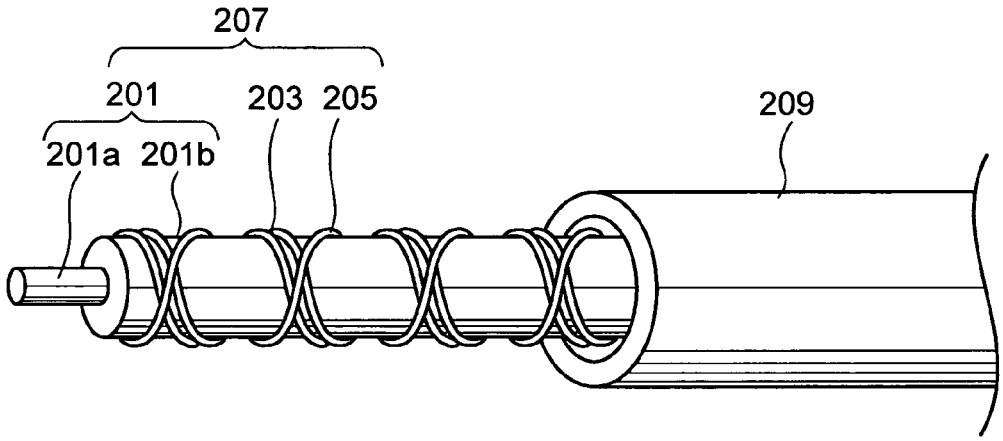
FIG. 8 is a perspective view according to a fifth embodiment of the present invention, in which a part of a cord type thermal fuse has been cut off.

Now a fifth embodiment of the present invention will be explained with reference to FIGS. 8 and 9. There is an insulating core member 201, comprising a tensile resistant member 201*a* and a cover member 201*b*. The tensile resistant member 201*a* was provided by applying silicone varnishing to a glass cord having the outer diameter of about 0.7 mm. Further, a compound of 100 w/t parts of silicone rubber, 1 w/t part of foaming agent (AIBN) and 2 w/t parts of organic peroxide cross-linking agent kneaded on open roll, is used for the cover member 201*b*. Then, the cover member 201*b* is extruded in order to cover the periphery of the tensile resistant member 201*a*, so that the cross-section of the outer diameter is 1.8 mm. At the same time, the silicone rubber is foamed by applying hot-air vulcanization. Thus, the insulating core member 201 is formed.

There are two parallel conductors 203 wound around the outer periphery of the insulating core member 201 in the length direction. Each conductor 203 comprises 0.5 mm of non-lead solder wire (tin-copper alloy, melting temperature at 217° C.) in which flux had been included at the center, and two of which are drawn at the same tension and wound at winding pitch of 5 times/10 mm (4 times the wire diameter) in the length direction around the insulating core member 201, so that the conductors 203 may dig into the insulating core member 201 sufficiently.

There is a fuse core 207, comprising a line-shaped insulator 205 wound around the outer periphery of the conductor 203 in the length direction. As for the line-shaped insulator 205, a monofilament of 0.4 mm polyphenylene sulfide is used, and the line-shaped insulator 205 is wound in the length direction, reverse to that of the conductor 203, at winding pitch of 10 times/32 mm (8 times the wire diameter).

The outer periphery of the thus obtained fuse core 207 is covered by tubular insulating cover 209. As for the insulating cover 209, a mixture of ethylene copolymer serving has been extruded at temperature of 150° C., in a tubular shape having the thickness of 0.3 mm and the outer diameter of 4.2 mm. Thereafter, the cross-linking is done by applying electron beam thereto, thus the cord type thermal fuse according to the present embodiment is obtained.

The insulating core member 201 is formed by any material, having characteristic of being not melted around the melting temperature of the conductor 203, and also characteristic of expanding in the circumferential direction, for example, any metal wire to which insulation process has been applied, such as an electric wire in which thermoplastic polymer or thermoset polymer has been extruded on a conductor, or cable material comprising any polymer which has been formed by plastic extrusion of synthetic fiber, thermoplastic polymer or thermoset polymer, or any inorganic material such as ceramic fiber or glass fiber. Any one of the above materials may be used as a single material, but it is also possible to use a plurality of materials by winding the parallel conductors 3, or by stranding together, or by preparing composite material through combination of different material types.

As discussed above, among these materials according to the present embodiment, with reference to the structure in which the tensile resistant member 201*a* at the center is covered by polymer material including the air serving as the cover member 201*b*, it is possible to improve the tensile strength and flexibility, and at the same time, it is also possible to arbitrarily control the degree of expansion of the cover member 201*b*. Thus, this structure is particularly preferable among others.

The tensile resistant material 201*a* may be formed by using any known textile material. Further, a polymer material including the air, serving as the cover member 201*b*, may have the structure that delomorphous or amorphous airtight spaces have been formed, preferably at least any part in the inside of polymer material comprising such as elastomer. There are various forming methods, for example, such as that polymer material has been mixed with organic foaming agent or inorganic foaming agent, and the mixture is heated and thus foamed, whereby the material having isolated air holes can be formed. Further, it is also possible to use other forming methods, such as by including gas during extrusion molding of polymer material, or forming of partially foamed material by adding sublimation material powder through heat-aging to polymer material, or forming of the airtight spaces, by preliminarily preparing polymer member having continuous holes in the length direction, and in the post-process, by closing the continuous holes in the length direction. As for the polymer material as discussed above, it is possible to use any ordinary elastomer material, for example, silicone rubber, ethylene propylene rubber, natural rubber, isoprene rubber, acrylic rubber, fluorocarbon rubber, ethylene-vinyl acetate copolymer (EVA), ethylene-ethyl acrylate copolymer resin (EEA), or any thermoplastic elastomer (TPE).

As for the conductor 203, it is possible to use, for example, metal thin wire selected from the group of low-melting point alloys and solder, or wire formed from conductive resin manufactured by filling high-density metal powder, metal oxide or carbon black, into thermoplastic resin such as olefin resin or polyamide resin. The preferable wire diameter of the conductor 203 is substantially from 0.4 mm to 2.0 mm, because an ordinary winding machine can wind such a conductor 203 around the insulating core member 201 in the length direction. The conductor 203 may be prepared by using a single conductor, or by using a plurality of paralleled materials through application of the same tension thereto, or by using a plurality of stranded materials.

The line-shaped insulator 205 is formed by any material, having a characteristic of being not melted at the melting temperature of the conductor 203, for example, a wire material comprising any polymer material in which synthetic fiber, thermoplastic polymer or thermoset polymer, such as aliphatic polyamide, aramid, polyethylene terephthalate, wholly aromatic polyester or novoloid has been formed by plastic extrusion, or a wire material comprising any inorganic material such as ceramic fiber or glass fiber. Any one of the above materials may be used as a single material, but it is also possible to use a plurality of materials by applying the same tension thereto, or by stranding together, or by preparing composite material through combination of different material types.

It is also possible to provide the line-shaped insulator 205 having characteristic of contracting in the length direction around the melting temperature of the conductor 203. Accordingly, the line-shaped insulator 205 may squeeze the conductor 203, whereby the disconnection of the conductor 203 may be done more securely. As for the line-shaped insulator 205 having characteristic of contracting in the length direction, it is possible to use, for example, any synthetic fiber such as aliphatic polyamide, aramid, polyethylene terephthalate or polybutylene terephthalate, or any fiber formed by high drawing of any of these synthetic fibers, or any thermoplastic resin such as polyethylene, polypropylene, aliphatic polyamide, polyethylene terephthalate, propylene fluoroethylene, vinylidene fluoride or ethylene-tetrafluoroethylene copolymer, which has been extruded in the shape of wire and drawn thereafter, or a wire material which has been formed by annealing of synthetic resin, such as polyacetal, of which contracting rate is relatively large.

It is also possible to provide the line-shaped insulator 205 having characteristic of expanding in the circumferential direction around the melting temperature of the conductor 203. Accordingly, the insulating core member 201 is expanded in the circumferential direction and presses the conductor 203 against the line-shaped insulator 205, and at the same time, the line-shaped insulator 205 is also expanded and presses the conductor 203 against the insulating core member 201, and these characteristics are preferable because the disconnection of the conductor 203 may be done more securely. As for the line-shaped insulator 205 having characteristic of expanding in the circumferential direction, it is possible to use any material of which positive expansion coefficient is large, for example, foamed cross-linked rubber, or cross-linked rubber including any foaming material such as ADCA, exfoliated graphite or low-boiling liquid contained in micro capsule, or cross-linked rubber formed by knealing and incorporating relatively low-boiling organic solvent in rubber, and after extrusion, formed by vaporizing the incorporated organic solvent by heat, or any material which has been formed by blowing a high-compression gas at the same time of extrusion molding of a synthetic resin, or a cross-linked rubber, which has been formed by adding heat sublimation material powder to an elastomer material, and thereafter, by heat sublimation of the added powder, or a cross-linked rubber, which has been formed by preliminarily preparing elastic member having continuous holes in the length direction during contour extrusion of elastomer material, and in the post-process, by closing the continuous holes in the length direction at predetermined intervals through use of winding tension of the conductor, which will be explained afterwards.

As there are various known materials and methods in regard to the insulating cover 209, it is possible to select any appropriate material and method from them, which can realize the working temperature lower than the melting temperature of the conductor 203. It is possible to use the method, for example, in which a thermoplastic polymer such as ethylene copolymer workable at relatively low temperature, or a synthetic rubber such as ethylene propylene rubber, styrene butadiene rubber, isoprene rubber or nitrile rubber, is cross-linked by using low-temperature cross-linking method such as radiation cross-linking. Further, it is also possible to use a forming method by using silicone rubber which can be extruded around normal temperature and which can be cross-linked at relatively low temperature. In particular, when the silicone rubber is used, it is also possible to provide a braid as exterior element in order to reinforce the mechanical strength of the insulating cover 209. The insulating cover 209 may be preferably thin, because of the increasing heat sensitivity, as long as the required characteristics such as the electric insulation ability and mechanical strength are satisfied.

The materials and numeric values as discussed above are mere examples of the embodiment, and it is possible to determine appropriately, according to using application, using purpose, using environment, etc.

Figure 10:
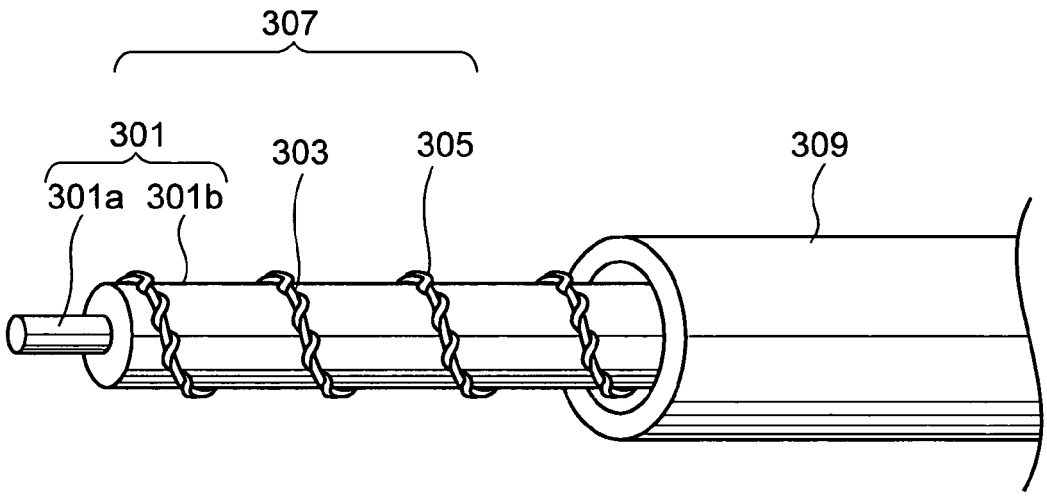
FIG. 10 is a perspective view according to a sixth embodiment of the present invention, in which a part of a cord type thermal fuse has been cut off.

Now a sixth embodiment of the present invention will be explained with reference to FIG. 10. There is a conductor 303, substantially the same as that of the fifth embodiment as discussed above, around which a line-shaped insulator 305, also substantially the same as that of the fifth embodiment, is wound in the length direction at winding pitch of 10 times/16 mm (4 times the wire diameter).

Thereafter, the conductor 303, around which the line-shaped insulator 305 has been wound in the length direction, is also wound around an insulating core member 301, substantially the same as that of the fifth embodiment, at winding pitch of 10 times/85 mm (6.5 times the wire diameter), thus a fuse core 307 is obtained. There is a tubular insulating cover 309 covering the outer periphery of the fuse core 307. The material of the insulating cover 309 is substantially the same as that of the fifth embodiment. Accordingly, a cord type thermal fuse according to the present embodiment is obtained.

Figure 11:
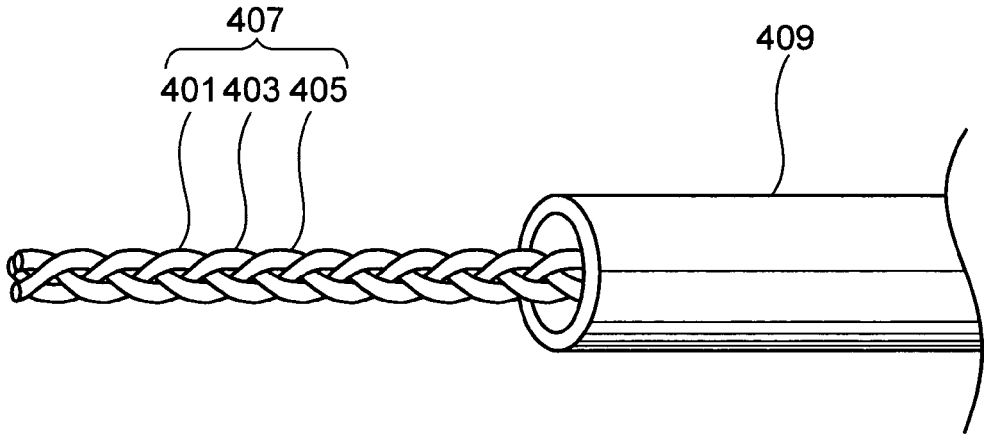
FIG. 11 is a perspective view according to a seventh embodiment of the present invention, in which a part of a cord type thermal fuse has been cut off.

Now a seventh embodiment of the present invention will be explained with reference to FIG. 11. There is an insulating core member 401, formed from a compound of 100 w/t parts of silicone rubber, 1 w/t part of foaming agent (AIBN) and 2 w/t parts of organic peroxide cross-linking agent kneaded on open roll. Then, this material for manufacturing the insulating core member 401 is extruded, so that the cross-section of the outer diameter is 1.2 mm. At the same time, the silicone rubber is foamed by applying hot-air vulcanization. Thus, the insulating core member 401 is formed.

Thereafter, the insulating core member 401, a conductor 403 and a line-shaped insulator 405, both substantially the same as those of the fifth embodiment, are stranded together at pitch of 3.0 mm, thus a fuse core 407 is obtained.

There is a tubular insulating cover 409 covering the outer periphery of the fuse core 407. The material of the insulating cover 409 is substantially the same as that of the fifth embodiment. Accordingly, a cord type thermal fuse according to the present embodiment is obtained.

Figure 12:
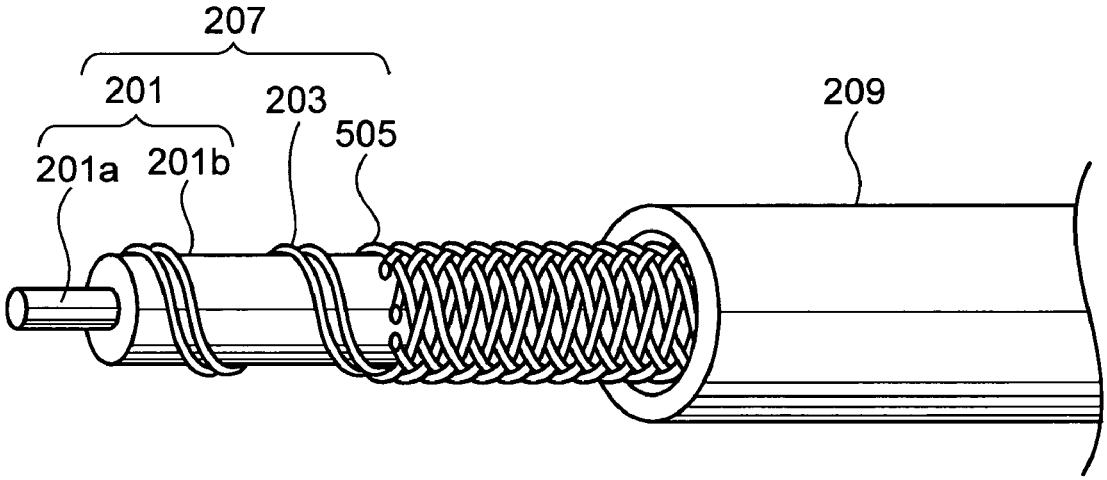
FIG. 12 is a perspective view according to an eighth embodiment of the present invention, in which a part of a cord type thermal fuse has been cut off.

Now an eighth embodiment of the present invention will be explained with reference to FIG. 12. According to the eighth embodiment, there is a braid 505, substantially serving as the line-shaped insulator of the fifth embodiment. The other structure is substantially the same as that of the fifth embodiment as discussed above, and the identical numerals are allotted to the identical elements, and the explanation thereof will not be made.

The fifth through eighth embodiments as discussed above have the following merits. First, as the insulating core members 201, 301 and 401 are expanded in the circumferential direction due to increase of temperature, and presses the conductors 203, 303 and 403 against the line-shaped insulators 205, 305 and 405 or against the braid 505. Accordingly, the conductors 203, 303 and 403 can be disconnected more securely during melting or just before melting. Thus, even when the original function of flux (the function to improve the detecting accuracy) is deteriorated due to aging by heat, etc., it is still possible to maintain the good disconnection time. Further, it is still effective even when any deterioration, such as forming of oxide, appears on the surface of the conductors 203, 303 and 403 due to long-term use thereof and the melting disconnection cannot be done easily. Thus, it is possible to further improve the operation reliability of the cord type thermal fuse against deterioration by aging.

As the conductors 203, 303 and 403 are covered by the tubular insulating covers 209, 309 and 409, there are so much space around the conductors 203, 303 and 403, that the conductors 203, 303 and 403 may be deformed. Accordingly, as the melted conductors 203, 303 and 403 are multiplied separately, the disconnection of the conductors 203, 303 and 403 will not be inhibited.

With reference to the fifth embodiment, there is an example, that the conductor 203 is wound around the insulating core member 201 in the length direction, and that the other line-shaped insulator 205 is wound in the length direction reverse to that of the conductor 203. It is also possible, for example, to use a plurality of the line-shaped insulators 205. Further, it is also possible to wind the line-shaped insulator 205 and the conductor 203 in the same length direction, as long as the winding pitch of the line-shaped insulator 205 is different from that of the conductor 203. It is also possible to add the line-shaped insulator 205 directly along the longitudinal direction.

As for the conductor 203, for example, it is also possible to add the conductor 203 to the insulating core member 201 directly along the longitudinal direction.

With reference to the sixth embodiment as discussed above, the explanation is made as for an example of winding a single line-shaped insulator 305 around the conductor 303 in the length direction, and then winding this unit around the insulating core member 301 in the length direction. However, it is also possible, for example, to use a plurality of line-shaped insulators 305, or to use a braid thereof, and it is also possible to use the conductor 303 and the line-shaped insulator 305 stranded together. Further, it is also possible to wind the conductor 303 around the line-shaped insulator 305 in the length direction. It is also possible to wind the line-shaped insulator 305 around the conductor 303 in the length direction, and to add it to the insulating core member 301 directly along the longitudinal direction.

According to the fifth and six embodiments as discussed above, the explanations are made as for examples of winding the conductors 203, 303 or line-shaped insulators 205, 305 around the insulating core members 201, 301 in the length direction. Further, according to the seventh embodiment, the explanation is made as for an example of stranding the insulating core member 401, the conductor 403 and the line-shaped insulator 405 together. It is also possible, for example, to use the conductor 203 wound around the insulating core member 205 in the length direction, or to use the insulating core member 201 and the conductor 203 stranded together in advance.

Figure 9:
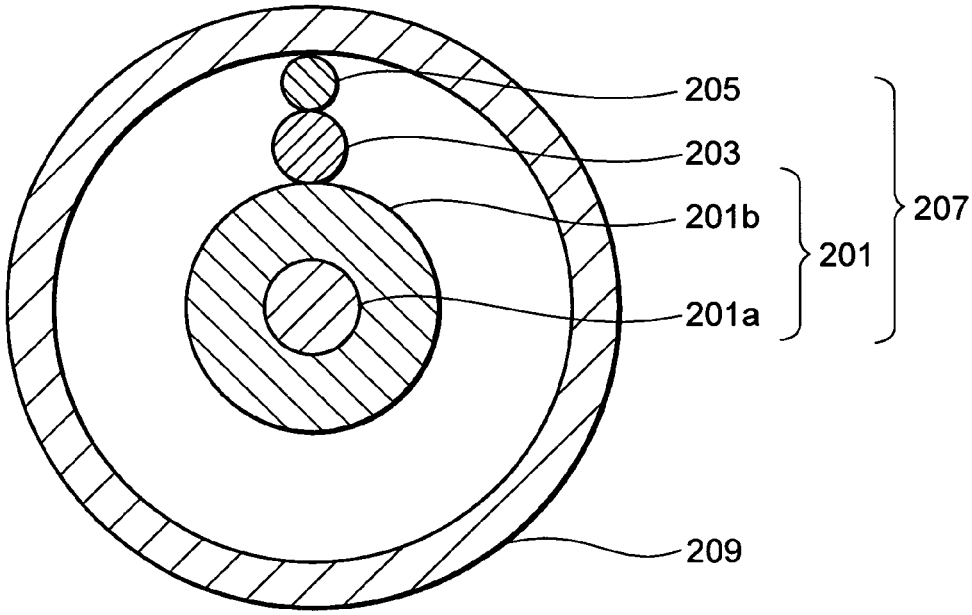
FIG. 9 is a sectional view of the cord type thermal fuse according to the fifth embodiment of the present invention.

As discussed above, it is possible to provide various examples, but each example is essentially characterized in that, as illustrated in FIG. 9, at least a part of the fuse core 207 (307, 407) in the length direction has the structure that the conductor 203 (303, 403) is sandwiched between the insulating core member 201 (301, 401) and the line-shaped insulator 205 (305, 405 or the braid 505).

In this connection, the characteristic evaluation test was done for Example 11 corresponding to the fifth embodiment, Example 12 corresponding to the sixth embodiment, and Examples 13 and 14 corresponding to the seventh embodiment, of which explanation will be done as follows.

For reference, according to Example 14, the line-shaped insulator 205 was not used in regard to the fifth embodiment.

First, each of the cord type thermal fuses according to Examples 11 through 14 was cut at length of about 20 cm, and each end of the insulating cover was removed for about 1 cm. Then, lead wires having the nominal cross-sectional area of 0.5 mm.sup.2, each of which was at length of 100 mm, were connected via crimp-type terminals, thus the cord type thermal fuse assembly was manufactured.

Then, Experiments 1 and 2, substantially the same as those of the first embodiment, were respectively done for the thus obtained cord type thermal fuse, of which results are shown in FIG. 13.

According to the results of FIG. 13, it was confirmed that, in regard to Examples 11 through 13, as compared with Example 14 in which the line-shaped insulator was not used, the operative temperature became lower, because of combination of the insulating core member, comprising the material having characteristic of expanding in the circumferential direction, with the line-shaped insulator.

Figure 14:
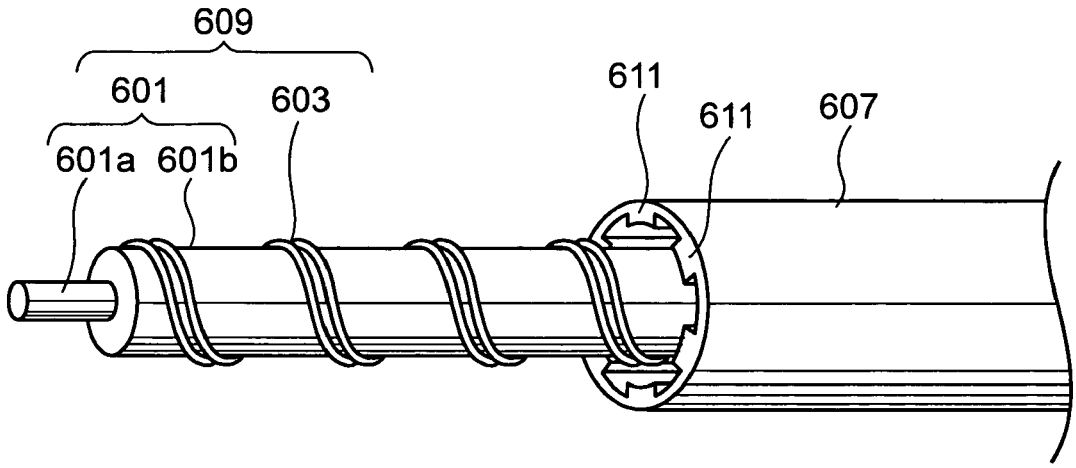
FIG. 14 is a perspective view according to a ninth embodiment of the present invention, in which a part of a cord type thermal fuse has been cut off.

Now a ninth embodiment of the present invention will be explained with reference to FIG. 14. According to the ninth embodiment, together with the expansion of an insulating core member, an insulating cover is contracted, whereby a conductor is disconnected, of which explanation will be done as follows.

There is an elastic core 601 including the air, and the elastic core 601 has a tensile resistant member 601*a* at the center, around which is covered by an elastic member 601*b* including the air. A conductor 603 is wound around the elastic core 601, and an insulating cover 607 is wound around the conductor 603. Thus, the elastic core 601 and the conductor 603 serve as a fuse core 609. Further, the insulating cover 607 has at least one or more (in the present embodiment, six) protrusions 611, formed continuously or intermittently on the inner surface in the length direction.

The insulating cover 607 has characteristic of contracting in the inward circumferential direction, and the material thereof is not limited, as long as the material belongs to pyrolysis polymer, and a plurality of material types may also be mixed with each other. It is possible to use, for example, any resin material such as polyester resin, polyamide resin, polyolefin resin (ethylene copolymer) or fluorocarbon resin, or any elastomer material such as nitrile rubber, ethylene propylene rubber, chloroprene rubber, acrylic rubber, silicone rubber or fluorocarbon rubber. According to the present embodiment, a mixture of ethylene propylene rubber with polyolefin resin (ethylene copolymer) at the mixing rate of 1:1 has been prepared, with which additives such as fire retardant, antioxidant, lubricant, cross-linking aids, etc., have been further mixed.

The contracting speed of the insulating cover 607 can be adjusted by pyrolysis temperature. When the pyrolysis temperature is high (i.e. when the mixture has much material having high pyrolysis temperature), the contracting speed will become lower. On the other hand, when the pyrolysis temperature is low (i.e. when the mixture has much material having low pyrolysis temperature), the contracting speed will become higher. Therefore, it is possible to determine the speed appropriately according to the using condition.

The other structure is substantially the same as that of the fourth embodiment as discussed above, and the identical numerals are allotted to the identical elements, and the explanation thereof will not be made.

Figure 15:
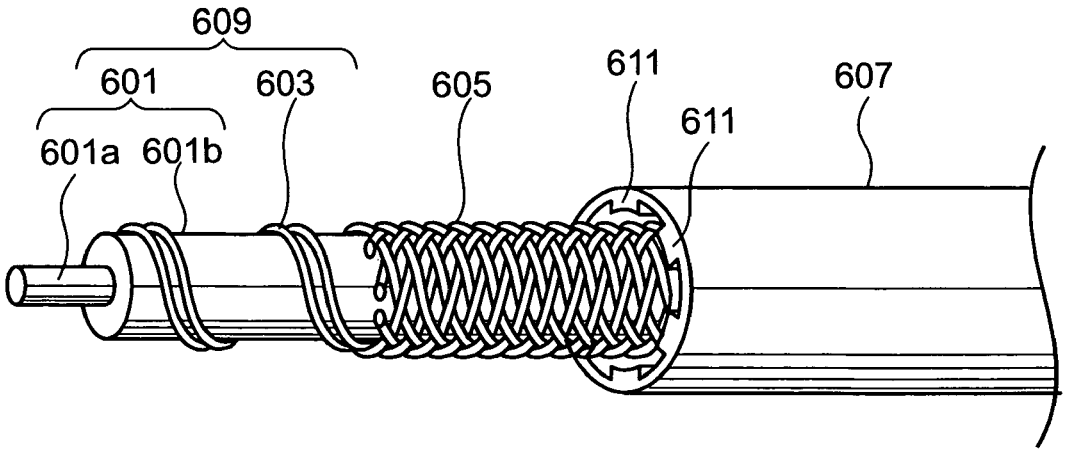
FIG. 15 is a perspective view according to a tenth embodiment of the present invention, in which a part of a cord type thermal fuse has been cut off.

Now a tenth embodiment of the present invention will be explained with reference to FIG. 15. According to the tenth embodiment, with reference to the ninth embodiment as discussed above, a space layer 605 comprising a glass braid is provided on the outer peripheral side of the conductor 603. The other structure is substantially the same as that of the ninth embodiment as discussed above, and the identical numerals are allotted to the identical elements, and the explanation thereof will not be made.

In this connection, the characteristic evaluation test was done for Examples 15, 16 and 17 corresponding to the ninth embodiment, and Example 18 corresponding to the tenth embodiment, of which explanation will be done as follows. The structure of each Example is substantially the same as that of Example 7 corresponding to the fourth embodiment as discussed above, except for the insulating cover 607 of Example 15.

According to Example 16, with reference to Example 15, the elastic member 601*b* was not kneaded with foaming agent (AIBN), whereby the conductor 603 was disconnected only by contracting of the insulating cover 607.

Further, according to Example 17, with reference to Example 15, an eutectic solder wire (melting temperature at 183.degree. C.) at diameter of 0.6 mm was used as the conductor 603.

First, each of the cord type thermal fuses according to Examples 15 through 18 was cut at length of about 20 cm, and each end of the insulating cover was removed for about 1 cm. Then, lead wires having the nominal cross-sectional area of 0.5 mm.sup.2, each of which was at length of 100 mm, were connected via crimp-type terminals, thus the cord type thermal fuse assembly was manufactured.

Then, Experiments 1 and 2, substantially the same as those of the first embodiment, were respectively done for the thus obtained cord type thermal fuse, and Experiment 3 as discussed below was also done respectively, of which results are shown in FIG. 16.

EXPERIMENT 3

Constant Temperature Heating After Lost of Flux

Experiment Method:

As for the thus manufacture cord type thermal fuse, flux was removed likewise the case of Experiment 2. Thereafter, the temperature was maintained at 260° C., 280° C. and 300° C., respectively, and the time until disconnection was measured.

According to the results of FIG. 16, it is confirmed that, with reference to the cord type thermal fuse of the present embodiment, by maintaining the elastic core 601 for a long time at a temperature (260° C.-300° C.) not higher than the operative temperature of the elastic core 601, the insulating cover 607 is contracted, whereby the conductor 603 is disconnected. When the elastic core 601 is maintained relatively at higher temperature (260° C.-300° C.) which is not higher than the operative temperature of the elastic core 601, the expanding motion of the elastic core 601 will not be facilitated, which would prevent disconnection of the conductor 603. Therefore, it is confirmed that the contracting motion of the insulating cover 607 is considerably effective.

According to the ninth and tenth embodiments as discussed above, the protrusions are provided on the inner periphery of the insulating cover 607. However, it is possible to provide the insulating cover 607 without having the protrusion.

INDUSTRIAL APPLICABILITY

The present invention relates to the cord type thermal fuse and a sheet type thermal fuse, which can be disconnected when any part thereof is exposed in an abnormal high temperature state, so that the abnormal temperature can be detected. More particularly, the present invention relates to the cord type thermal fuse and the sheet type thermal fuse, of which disconnection time is still good even after being deteriorated due to aging by heat, and which has good operative reliability. The present invention may be used for various purposes, for example, refrigerators, indoor and outdoor equipment of air conditioners, cloth drying machines, rice cookers with a keep-warm function, hot plates, coffee brewers, water heaters, ceramic heaters, oil heaters, automatic dispensers, electric blankets, floor heating panels, copying machines, facsimile machines, dishwashers, fryers, etc.

The invention claimed is:

1. A cord type thermal fuse comprising:

a fuse core produced by winding a conductor meltable at a predetermined temperature on an insulating core member continuously provided in the length direction of said conductor; and an insulating cover covering the outer periphery side of said insulating core member, characterized in that:

said conductor can be broken by expanding said insulating core member at a predetermined temperature and/or by contracting said insulating cover at said predetermined temperature; and said insulating core member comprises a gas-containing material;

covering a periphery of a tensile resistant member at the center of said insulating core member.

2. The cord type thermal fuse as claimed in claim 1, further characterized in that:

said insulating core member has at least one or more protrusions formed continuously or intermittently in the length direction of said conductor on the outer periphery side of said insulating core member.

3. The cord type thermal fuse as claimed in claim 2, further characterized in that:

said insulating cover has at least one or more protrusions formed continuously or intermittently in the length direction of said conductor on the inner periphery side of said insulating cover.

4. The cord type thermal fuse as claimed in claim 2, further characterized in that:

said insulating core member comprises a gas-containing material as a structural element.

5. A sheet type thermal fuse, comprising:

the cord type thermal fuse according to claim 2, provided on a flat surface in a serpentine manner; and means for fixing a layout of said core type thermal fuse.

6. The cord type thermal fuse as claimed in claim 1, further characterized in that:

said insulating cover has at least one or more protrusions formed continuously or intermittently in the length direction of said conductor on the inner periphery side of said insulating cover.

7. The cord type thermal fuse as claimed in claim 6, further characterized in that:

said insulating core member comprises a gas-containing material as a structural element.

8. A sheet type thermal fuse, comprising:

the cord type thermal fuse according to claim 6, provided on a flat surface in a serpentine manner; and means for fixing a layout of said core type thermal fuse.

9. The cord type thermal fuse as claimed in claim 1, further characterized in that:

a line-shaped or braid-shaped insulator is provided on an inner peripheral side of said insulating cover; and said conductor is sandwiched between said insulating core member and said line-shaped or braid-shaped insulator at least partially in the length direction of said conductor.

10. The cord type thermal fuse as claimed in claim 9, further characterized in that:

said line-shaped or braid-shaped insulator has a characteristic of contracting in the length direction of said conductor around a melting temperature of said conductor.

11. The cord type thermal fuse as claimed in claim 10, further characterized in that:

said insulating core member comprises a gas-containing material as a structural element.

12. A sheet type thermal fuse, comprising:

the cord type thermal fuse according to claim 10, provided on a flat surface in a serpentine manner; and means for fixing a layout of said core type thermal fuse.

13. The cord type thermal fuse as claimed in claim 9, further characterized in that:

said line-shaped or braid-shaped insulator has a characteristic of expanding in a radial direction around a melting temperature of said conductor.

14. The cord type thermal fuse as claimed in claim 13, further characterized in that:

said insulating core member comprises a gas-containing material as a structural element.

15. A sheet type thermal fuse, comprising:

the cord type thermal fuse according to claim 13, provided on a flat surface in a serpentine manner; and means for fixing a layout of said core type thermal fuse.

16. The cord type thermal fuse as claimed in claim 9, further characterized in that:

said insulating core member comprises a gas-containing material in airtight spaces.

17. A sheet type thermal fuse, comprising:

the cord type thermal fuse according to claim 9, provided on a flat surface in a serpentine manner; and means for fixing a layout of said core type thermal fuse.

18. The cord type thermal fuse as claimed in claim 1, further characterized in that:

said insulating core member comprises a gas-containing material as a structural element.

19. A sheet type thermal fuse, comprising:

the cord type thermal fuse according to claim 1, provided on a flat surface in a serpentine manner; and means for fixing a layout of said core type thermal fuse.

* * * * *